US006679637B2

(12) United States Patent
Tsuruta et al.

(10) Patent No.: US 6,679,637 B2
(45) Date of Patent: Jan. 20, 2004

(54) PRINTING APPARATUS AND PRINTING METHOD

(75) Inventors: Wataru Tsuruta, Yamanashi (JP); Tsuyoshi Kubota, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 10/206,994

(22) Filed: Jul. 30, 2002

(65) Prior Publication Data

US 2003/0026635 A1 Feb. 6, 2003

(30) Foreign Application Priority Data

Aug. 3, 2001 (JP) ..... 2001-235716

(51) Int. Cl.[7] ..... B41J 2/315

(52) U.S. Cl. ..... 400/120.01; 347/171; 347/103; 101/232

(58) Field of Search ..... 400/120.01; 347/171, 347/103; 101/232

(56) References Cited

U.S. PATENT DOCUMENTS 5,373,350 A * 12/1994 Taylor et al. ..... 399/2
5,561,500 A * 10/1996 Ohzeki et al. ..... 399/85
5,760,928 A * 6/1998 Motoyama et al. ..... 358/501
5,781,823 A * 7/1998 Isobe et al. ..... 399/2
5,959,278 A * 9/1999 Kobayashi et al. ..... 235/449
5,980,136 A * 11/1999 Teumer et al. ..... 400/521
6,249,303 B1 * 6/2001 Mochizuki et al. ..... 347/222
6,341,860 B1 * 1/2002 Harris ..... 347/103

FOREIGN PATENT DOCUMENTS

| | | |
|---|---|---|
| JP | 8-58125 | 3/1996 |
| JP | 8-332742 | 12/1996 |
| JP | 9-131930 | 5/1997 |

* cited by examiner

*Primary Examiner*—Andrew H. Hirshfeld
*Assistant Examiner*—Andrea H. Evans
(74) *Attorney, Agent, or Firm*—Kanesaka & Takeuchi

(57) ABSTRACT

An printing apparatus is equipped with a recording medium transport device for transporting a recording medium from a supply portion along a transport path; at least one printing device arranged on the transport path for selectively forming an image on the recording medium or an intermediate transfer medium for temporarily holding the image at a predetermined image forming position; and a transfer device arranged on the transport path for transferring the image formed on the intermediate transfer medium to the recording medium. A mode setting device selects a mode between the first mode in which the printing device forms the image on the recording medium and the second mode in which the printing device forms the image on the intermediate transfer medium. An intermediate transfer medium moving device advances and retracts the intermediate transfer medium between the image forming position and a retracted position.

9 Claims, 9 Drawing Sheets

PRINTING APPARATUS AND PRINTING METHOD

BACKGROUND OF THE INVENTION AND RELATED ARTS STATEMENT

This invention relates to a printing apparatus for printing a variety of information such as images and characters on a recording medium, such as a card. More particularly, this invention relates to a printing apparatus that are capable of switching printing methods according to characteristics of a recording medium or information for printing a variety of information.

Conventionally, a thermal transfer printing apparatus has been used to record a desired image or a character on a card recording medium such as a credit card, a cash card, a license card or an ID card by thermally transferring with a thermal head via a thermal transfer film. As an example, in Japanese Patent Publication (TOKKAI) No. 09-131930, a printing apparatus using a direct transfer method has been disclosed. The apparatus directly transfers an image and a character to a recording medium via a thermal transfer film. This method has an advantage of attaining a high quality image due to thermal sublimate ink. However, the recording medium needs to have a receptive layer on its printing surface to receive the ink. Therefore, only limited recording medium can be used, or the receptive layer needs to be formed on the surface of the recording medium.

Generally, a card made of a polyvinyl chloride (known as a PVC card) has been widely used as the recording medium that can receive the thermal sublimate ink. However, since the PVC card generates toxic substances when burned, recently it has been tried to switch to a card made of a polyethylene terephthalate (also known as a PET card).

Furthermore, in recent years, a new type of card media such as an IC card, which embeds an IC chip or antenna inside, has been used in a variety of fields. Because of the embedded elements, this type of card has an uneven surface, resulting in a printing problem.

In Japanese Patent Publication (TOKKAI) No. 08-332742, a printing apparatus using an indirect transfer technology, in which an image is transferred to an intermediate transfer medium after the image is transferred to a final recording medium, has been disclosed to solve the above problem. According to this method, it is possible to overcome the problems such as limited recording medium related to the receptive layer or the issue of printing on an uneven surface of the recording medium. Furthermore, this method makes it easier to print an image on an entire surface of the card medium as opposed to the direct transfer method.

However, in the intermediate transfer method, a running cost tends to be higher than that of the direct transfer method because of the intermediate transfer medium. Also, it takes longer time to finish printing. Furthermore, in terms of a card design, there are many cases where a front side needs to be printed on a whole area while only limited area such as precautions for card use is needed to print on a backside. Thus, there are merits and demerits for both printing methods. Therefore, it is possible to reduce a running cost by selecting a method most appropriate to a recording medium if a printing apparatus can switch between the direct transfer method and the indirect transfer method to print an image on a recording medium depending on an objective of printing. It is expected that such a printing apparatus will be used more widely in the future.

However, a printing apparatus that can apply the two printing methods requires a complex printing process, resulting in an increase in processing errors of the printing process.

An object of the present invention is to provide a printing apparatus that can switch between the direct transfer method and the indirect transfer method for printing and can reduce problems associated with the printing process.

Another object of the present invention is to provide a printing apparatus that reduces mechanical errors and failures inside of the printing apparatus while improving printing capacity such as a processing time or throughput time per specific number of the media.

Further objects and advantages of the invention will be apparent from the following description of the invention.

SUMMARY OF THE INVENTION

To attain the objectives, in the first aspect of the present invention, an printing apparatus is equipped with a recording medium transport device for transporting a recording medium supplied from a supply portion along a transport path; at least one printing device arranged on the transport path of the recording medium transport device for selectively forming an image on the recording medium and an intermediate transfer medium for temporarily holding the image at a predetermined image forming position; a transfer device arranged on the transport path of the recording medium transport device for transferring the image formed on the intermediate transfer medium on the recording medium; a mode setting device for selecting a mode between the first mode in which the printing device forms the image on the recording medium and the second mode in which the printing device forms the image on the intermediate transfer medium; and an intermediate transfer medium moving device for advancing and retracting the intermediate transfer medium between the image forming position and a retracted position according to the first mode and the second mode selected by the mode setting device.

The recording medium transport device transports the recording medium from the supply portion along the transport path. At least one printing device and the transfer device are arranged on the transport path in the recording medium transport device. When the first mode is set by the mode setting device to form an image on the recording medium, the printing device forms the image on the recording medium at the predetermined image forming position. When the second mode is selected to form an image on the intermediate transfer medium that temporarily holds the image, the printing device forms the image on the recording medium, and the image formed on the intermediate transfer medium by the printing device is transferred to the recording medium by the transfer device. The intermediate transfer medium advancing device advances the intermediate transfer medium between the image forming position and the retracted position according to the first and the second modes set by the mode setting device. According to this aspect, images are formed on the recording medium by the printing device based on the mode. Because the images formed on the intermediate transfer medium by the printing device are transferred to the recording medium by the transfer device, it is possible to switch between the direct transfer method and the indirect transfer method when printing the recording medium. Also, it is possible for the intermediate transfer medium moving device to retract the intermediate transfer medium to the retracted position according to the mode to make one transfer device idle when the other transfer device is in use thereby decreasing a problem associated with printing and improving the printing performance.

In that case, the intermediate transfer medium moving device may move the intermediate transfer medium to the retracted position when the mode setting device selects the first mode, or may move the intermediate transfer medium to the image forming position when the mode setting device selects the second mode. The intermediate transfer medium moving means includes the first platen capable of being arranged opposite to the printing device, and the intermediate transfer medium contacts an outer circumference thereof. The intermediate transfer medium moving means also includes the second platen capable of being arranged adjacent to the first platen and opposite to the printing device. One of the first and the second platens may be arranged opposite to the printing device, or the intermediate transfer medium may be detachable from the outer circumference of the platen arranged opposite to the printing device.

Also, to attain the aforementioned objectives, in the second aspect of the invention, a printing method includes the steps of transporting a recording medium and an intermediate transfer medium for holding an image temporarily to an image forming position; selectively forming an image on the recording medium and the intermediate transfer medium at the image forming position; transporting the recording medium to an image transfer position; and transferring the image formed on the intermediate transfer medium to the recording medium at the image transfer position. When forming the image on the recording medium at the image forming position, it is prohibited to form the image on the intermediate transfer medium.

According to this aspect, the printing apparatus transports the recording medium and intermediate transfer medium that holds the image temporarily to the image forming position and selectively forms the image on the recording medium and the intermediate transfer medium at the image forming position. When forming the image on the recording medium at the image forming position, it is prohibited to from the image on the intermediate transfer medium. The recording medium is transported to the image forming position, and the image formed on the intermediate transfer medium is transferred to the recording medium at the image transfer position. In this case, the intermediate transfer medium is separated from the image forming position so that it is prohibited to from the image on the intermediate transfer medium. In such a case, when the mode of forming the image on the recording medium is set, it is acceptable to either prohibit the image forming on the intermediate transfer medium or to separate the intermediate transfer medium from the image forming position.

Further objects and advantages of the invention will be apparent from the following description of the invention.

BRIEF DESCRIPTION OF THE DRAWINGS

FIG. 2A and FIG. 2B are views showing a thermal transfer sheet and an intermediate transfer sheet, wherein FIG. 2A is a front view showing a model of the thermal transfer sheet, and FIG. 2B is a sectional view showing a model of the intermediate transfer sheet;

FIG. 5A and FIG. 5B are front views near the first card transport path of the printing apparatus according to the embodiment, wherein FIG. 5A shows a state that two carriers are positioned at a retracted position, and FIG. 5B shows a state that a carrier is positioned at the retracted position, and a leading edge of a card is positioned at the image forming position after another carrier is positioned at the image forming position;

FIG. 6A and FIG. 6B are front views near the first card transport path of the printing apparatus according to the embodiment of the present invention, wherein FIG. 6A shows a state that an image is formed on the card at the image forming position, and FIG. 6B shows a state that an image is formed on the intermediate transfer sheet at the image forming position;

DETAILED DESCRIPTION OF PREFERRED EMBODIMENTS

Hereunder, preferred embodiments of the invention will be explained with reference to the accompanied drawings.

Figure 1:
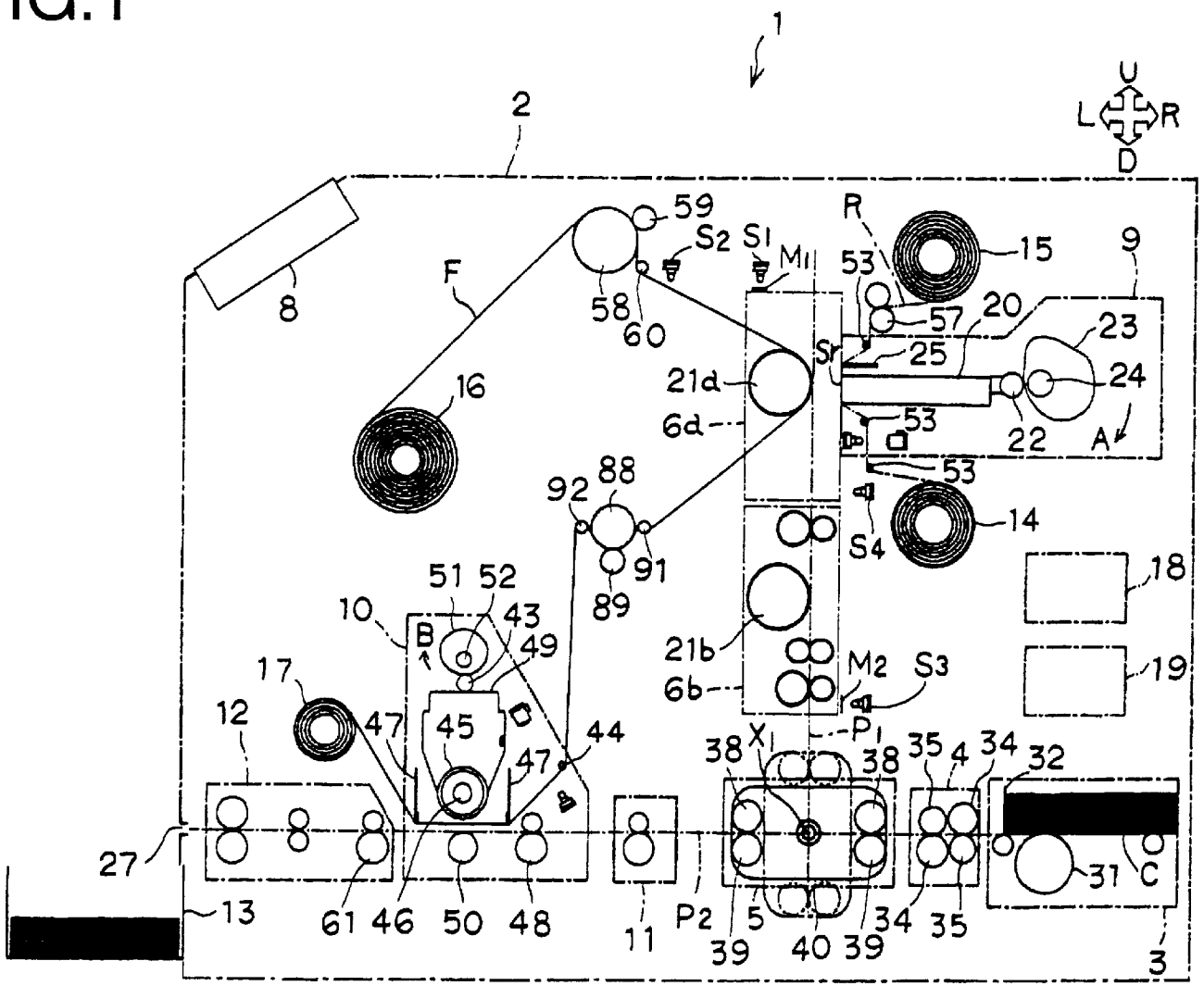
FIG. 1 is a front view showing a configuration of a printing apparatus according to an embodiment of the present invention.

As seen in FIG. 1, according to an embodiment of the present invention, a printing apparatus 1 in a housing 2 comprises the first card transport path P1 for forming (printing) an image on the card C using the direct transfer method and the second card transport path P2 for transferring an image temporarily held on an intermediate transfer sheet F as an intermediate transfer medium to the card C using an indirect transfer method. The second card transport path P2 is disposed substantially horizontally, and the first card transport path P1 is disposed substantially vertically. The first card transport path P1 and the second card transport path P2 intersect each other at an intersecting point X1.

On the second card transport path P2 are arranged a card supply portion 3 for separating and feeding the card C one by one to the second card transport path P2, a cleaner 4 for cleaning a front surface of the card C at downstream of the card supply portion 3, and a turning portion 5 for rotating the card C around the intersection point X1 while nipping the card C to switch the card C transport path directly toward the first card transport path P1 at downstream of the cleaner 4.

The card supply portion 3 comprises a card stacker to store a stack of blank cards C. A stacker side plate 32 with an opening slot to allow only one card C to pass therethrough is arranged at a position facing the second card transport path P2 on the card stacker. To a bottom of the card stacker is pressingly arranged a kick roller 31 for feeding the bottommost blank card C in a stack stored in the card stacker to the second card transport path P2.

The turning portion 5 comprises a pair of pinch rollers 38 and 39 that are capable of nipping the card C and a rotating frame 40 for supporting these pinch rollers to rotate or invert around the intersecting points of X1. One of the pinch rollers 38, 39 is a driving roller, and the other follows a drive of the one roller. The pinch rollers 38 and 39 press together sandwiching the second card transport path P2 when the rotating frame 40 is in a horizontal state (shown by a solid line in FIG. 1) and press together sandwiching the first card transport path P1 when the rotating frame 40 is in a vertical state (shown by a phantom line in FIG. 1) . If the rotating frame 40 is rotated or inverted while nipping the card between the pinch rollers 38 and 39, the pinch rollers 38 and 39 would rotate together to displace the card C. Thus, the rotating or turning action at the first turning portion 6 is driven independently from the rotation or inversion of the rotating frame 40 and the rotation of the pinch rollers 38 and 39.

A unit transmission sensor (combined with a slit plate) (not shown) to detect a rotational angle of the rotating frame 40 is disposed near the turning portion 5. Also, in order to determine a rotational direction of the pinch rollers 38 and 39, a unit transmission sensor (combined with a semi-circular plate) (not shown) is disposed to detect a position of either of the pinch rollers 38 and 39, so it is possible to set a rotating angle of the rotating frame 40 and control a transport direction of the card C by the pinch rollers 38 and 39.

The printing apparatus 1 comprises a carrier 6*b* movable (retractable) in the arrow direction U or the arrow direction D (Y) between the image forming position and the retracting position and having a platen roller 21*b* as the second platen; a carrier 6*a* movable in the arrow direction L or the arrow direction R (X) between the image forming position and a thermal head 20 and having a platen roller 21*a* as the first platen; and an image forming portion 9 as printing means for forming an image on the card C or the intermediate transfer sheet by heating the thermal transfer sheet R according to image and character information in series at downstream of the turning portion 5 (on the arrow U side of FIG. 1) on the first card transport path P1.

Figure 5A:
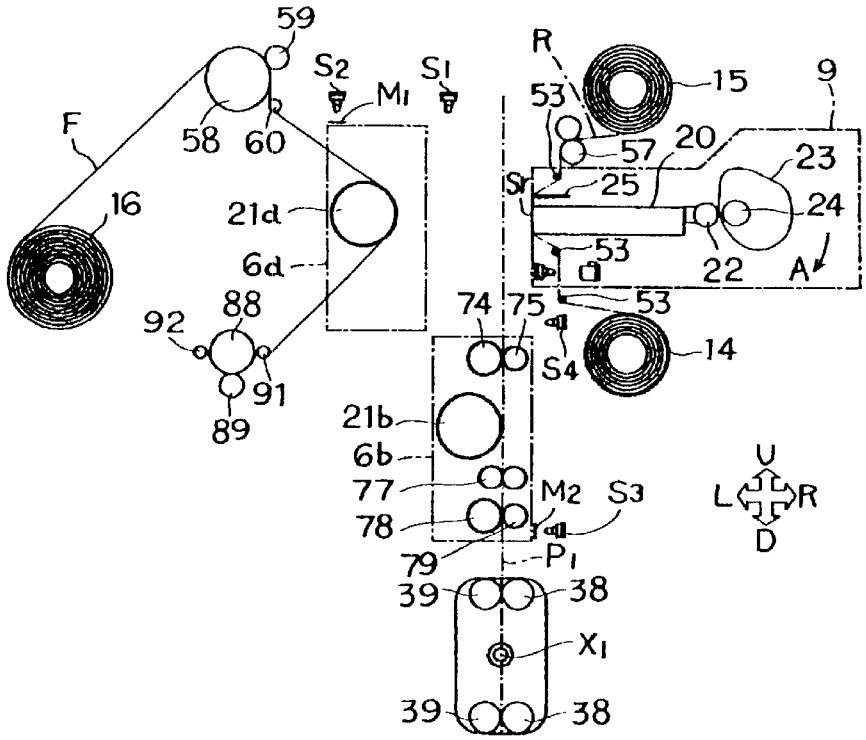

As can be seen in FIG. 1, the carrier 6*a* is positioned at the image forming position when an outer circumference surface of the platen roller 21*a* contacts the first card transport path P1. As can be seen in FIG. 5A, the carrier 6*a* is positioned at the retracted position when the outer circumference surface of the platen roller 21*a* is separated from the first card transport path P1. Unit transmission sensors S1 and S2 detect whether the carrier 6*a* is positioned at the image forming position or the retracted position. The unit transmission sensors S1 and S2 emit light to the mirror M1 mounted on the carrier 6*a* and output a high-level signal when the unit transmission sensors receive the reflected light. To the carrier 6*a* is mounted a rack rail on a backside of the sheet surface of FIG. 1 in the X direction described above. A pinion gear engages the rack rail for receiving a rotational drive of the pulse motor PM1 (not shown) to move the carrier 6*a* between the image forming position and retracted position. Furthermore, the platen roller 21*a* can rotate in a clockwise or counterclockwise direction through a rotational drive of the pulse motor PM2 (not shown), which is capable of moving as a unit with the carrier 6*a*.

Figure 5B:
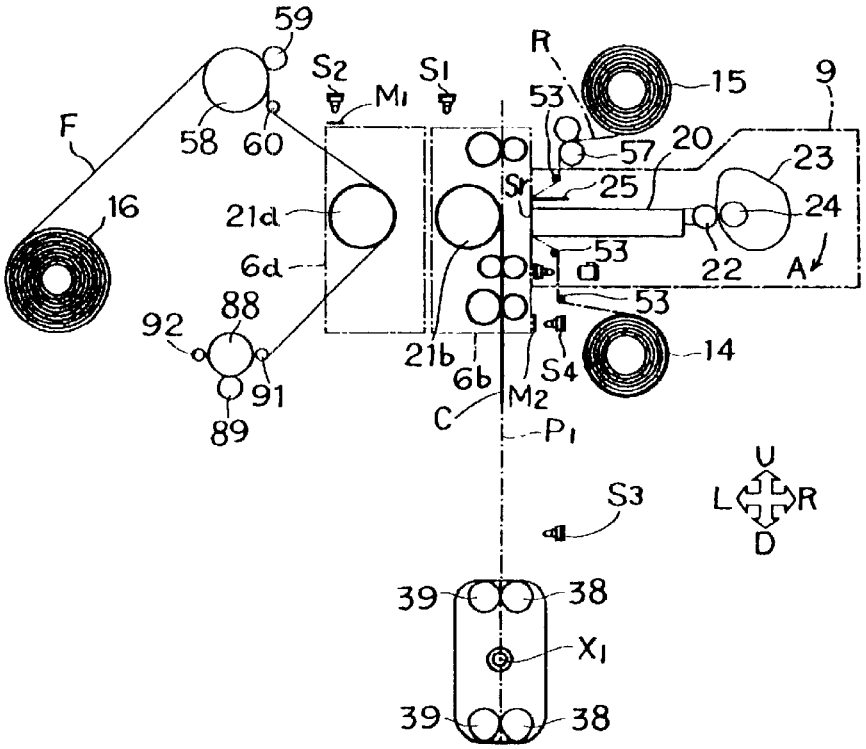
Figure 6A:
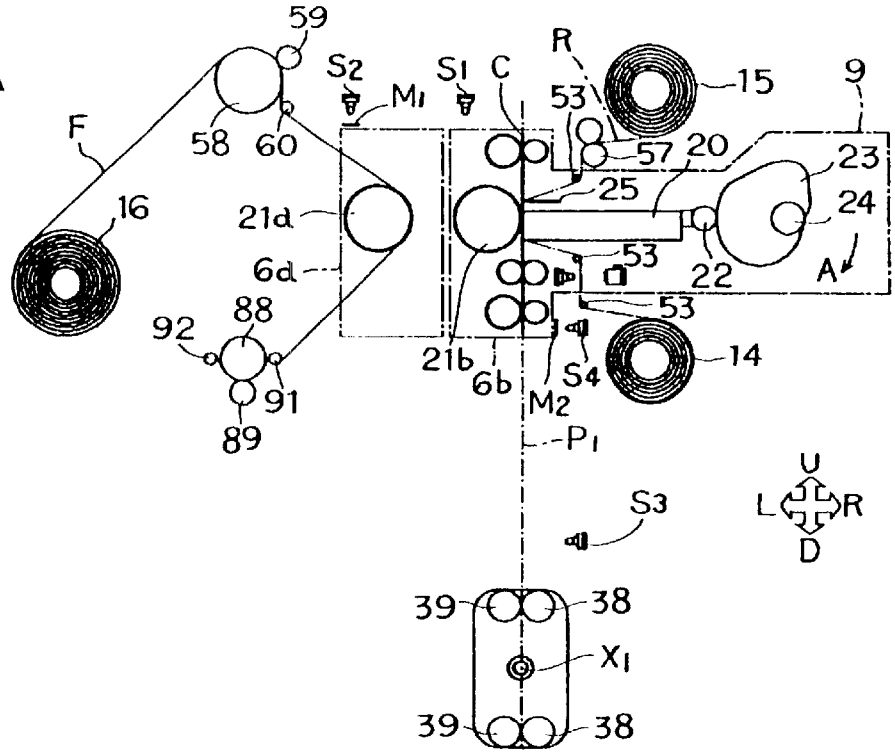
Figure 6B:
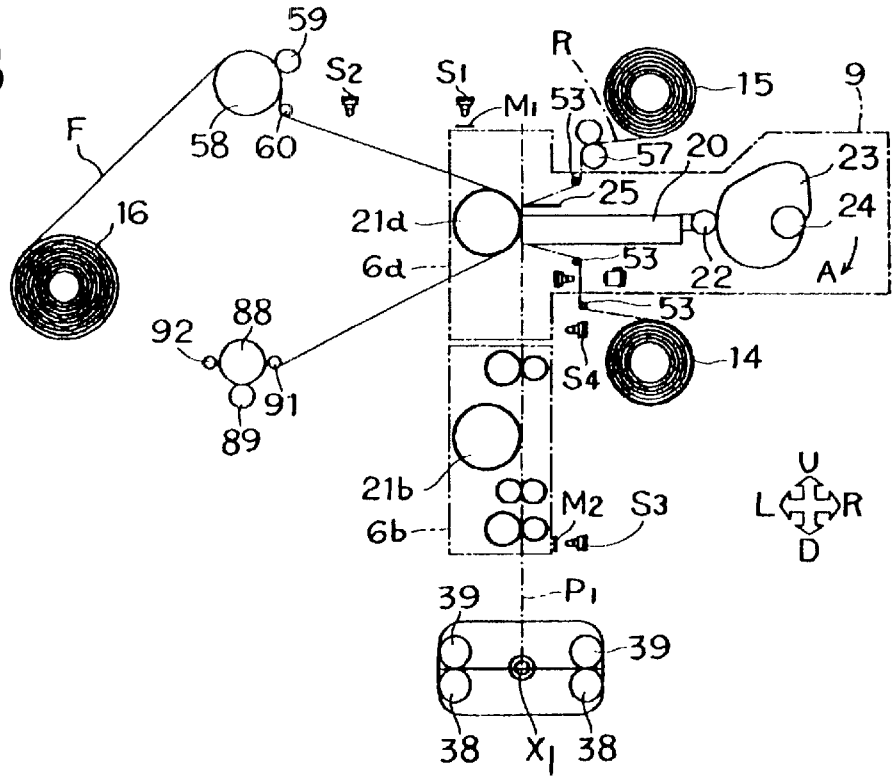

The carrier 6*b* is positioned at the retracted position when the platen roller 21*b* is separated from the image forming portion 9, as can be seen in FIG. 1 and FIG. 5A. As shown in FIG. 5B, the carrier 6*b* is positioned at the image forming position when the platen roller 21*b* is positioned opposite to the thermal head 20. Unit transmission sensors S3 and S4 detect whether the carrier 6*b* is positioned at the image forming position or the retracted position. The unit transmission sensors S3 and S4 emit light to the mirror M2 mounted on the carrier 6*b* and output a high-level signal when the unit transmission sensors receive the reflected light. To the carrier 6*a* is mounted a rack rail on a front side of the sheet surface of FIG. 1 parallel to the first card transport path P1. A pinion gear engages the rack rail for receiving a rotational drive of the pulse motor PM3 (not shown) to move the carrier 6*b* between the image forming position and retracted position. Note that the carrier 6*b* is positioned at the retracted position when the carrier 6*a* is positioned at the image forming position, and the carrier 6*a* is positioned at the retracted position when the carrier 6*b* is positioned at the image forming position.

As can be seen in FIG. 5A, the carrier 6*b* comprises a pair of upper rollers composed of a capstan roller 74 with a constant rotating speed and a pinch roller 75 pressing against the capstan roller 74 to sandwich the first card transport path P1; a pair of lower rollers composed of a capstan roller 78 and a pinch roller 79 pressing against the capstan roller 78 to sandwich the first card transport path P1; and a pair of rollers with no drive arranged between the platen roller 21*b* and a pair of the lower rollers nipping the first card transport path P1. The platen roller 21*b* rotates in both clockwise and counterclockwise directions through a rotational drive from the pulse motor M4 (not shown) that is movable as a unit with the carrier 6*b*. At the same time, the rotational drive from the pulse motor M4 is transmitted to the capstan rollers 74 and 78 via a plurality of gears (not shown). Thus, the capstan rollers 74 and 78 can rotate in the clockwise direction in synchronization when the platen roller 21*b* rotates in the clockwise direction.

The image forming portion 9 employs a configuration of a thermal transfer printer and comprises the thermal head 20 arranged retractably to the platen rollers 21*a* and 21*b*. As is shown in FIG. 1, FIGS. 5A, 5B and FIGS. 6A, 6B, advancing and retracting movements of the thermal head 20 to and from the platen rollers 21*a* and 21*b* are performed by a thermal head sliding drive unit, which comprises a detachable holder (not shown) supporting the thermal head 20; a follower roller 22 mounted to the holder; a non-circular thermal head sliding cam 23 rotating in either direction (the arrow direction A or the opposite direction) around the cam shaft 24 while following an outer contour of the follower roller 22; and the spring (not shown) pressing the holder against the thermal head sliding cam 23.

Figure 2A:
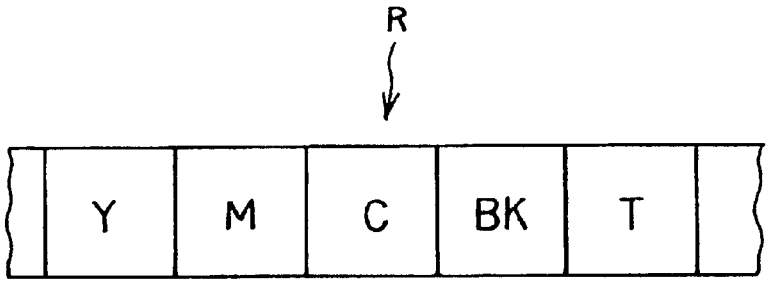

The thermal transfer sheet R is trained on a distal end of the thermal head 20. As shown in FIG. 2A, the thermal transfer sheet R sequentially carries inks, namely Y (yellow), M (magenta), C (cyan) and Bk (black), on the film in a width slightly larger than a length of the card C. A protective layer region T for protecting the card C surface is formed thereon next to the Bk (black), and this pattern is repeated along the film. As shown in FIG. 1, the thermal transfer sheet R is supplied from the thermal transfer sheet supply portion 14 where the thermal transfer sheet R is wound in a roll. The thermal transfer sheet R is guided by a plurality of guide rollers 53 and the guide plate 25 fastened to the holder (not shown), then is driven along with a rotation of the paired take-up roller 57 while contacting substantially the entire surface of the leading edge of the thermal head 20. Finally, the sheet is rolled on the thermal transfer sheet take-up portion 15. The thermal transfer sheet supply portion 14 and the thermal transfer sheet take-up portion 15 are disposed at both sides of the thermal head 20, and centers thereof are mounted onto the spool shaft.

In the image forming portion 9, a light emitting element $S_3$ and a light receiving element $S_4$ for detecting a positioning mark of the thermal transfer sheet R and the Bk portion on the thermal transfer sheet R are arranged between the guide rollers 53 disposed between the thermal transfer sheet supply portion 14 and the thermal head 20, being away from and perpendicular to the thermal transfer sheet R. A gear (not shown) is attached to a roller shaft of the paired take-up rollers 57 at a drive side, and engages another gear with a clock plate (not shown) on the same shaft. A unit transmission sensor (not shown) is disposed near the clock plate for detecting the rotation of the clock plate to control a wound amount of the thermal transfer sheet R.

As can be seen in FIG. 1, FIGS. 5A, 5B and FIGS. 6A, 6B, when the carriers 6*a* and 6*b* are positioned at the image forming position, the printing position (a heating position) Sr of the thermal head 20 relative to the intermediate transfer sheet F or the card C corresponds to a circumference in contact with the first card transport path P1 of the platen rollers 21*a* and 21*b*. More specifically, the image forming position is an area where the printing position Sr of the thermal head 20 touches the platen roller 21*a* or the platen roller 21*b* through the thermal transfer sheet R and the card C or the intermediate transfer sheet F.

Figure 2B:
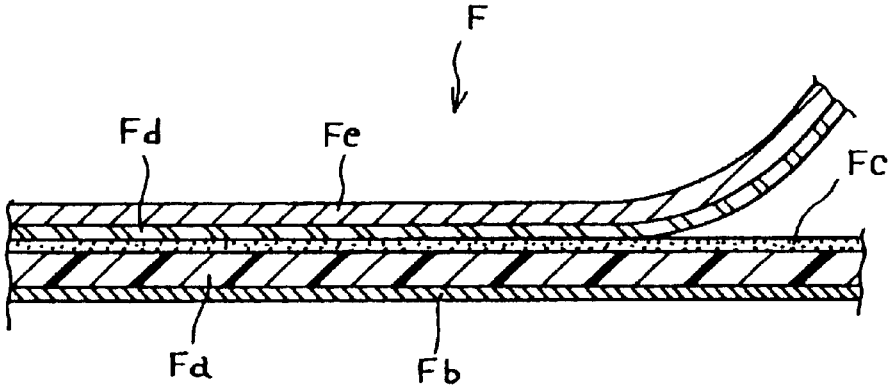

To the platen roller 21*a*, the intermediate transfer sheet F is trained on the circumference thereof at the thermal head 20 side. As shown in FIG. 2B, the intermediate transfer sheet F is formed of a base film Fa; a backside coating layer Fb formed on a backside of the base film Fa; a receptive layer Fe for receiving ink; an overcoat layer Fd for protecting the receptive layer Fe surface; and a peeling surface Fc formed on a front side of the base film Fa for thermally joining the overcoat layer Fd and the receptive layer Fe to promote peeling thereof from the base film Fa. Each layer is laminated in the order of the back surface coating layer Fb, the base film Fa, the peeling surface Fc, the overcoat layer Fd and the receptive layer Fe from the bottom. The intermediate transfer sheet F is trained with the receptive layer Fe facing the thermal transfer sheet R and the back coating layer Fb touching the platen roller 21*a*.

As shown in FIG. 1, in the printing apparatus 1, on the second card transport path P2 at downstream of the first turning portion 6 are disposed in series a pair of horizontal transport rollers 11 to transport the card C in a horizontal direction; the transfer portion 10 to transfer an image formed on the intermediate transfer sheet F to the card C at the image forming portion 9; and the horizontal transport portion 12 comprising a plurality of transport rollers to transport the card C horizontally and discharge rollers to discharge the card C to outside of the frame 2.

Figure 7:
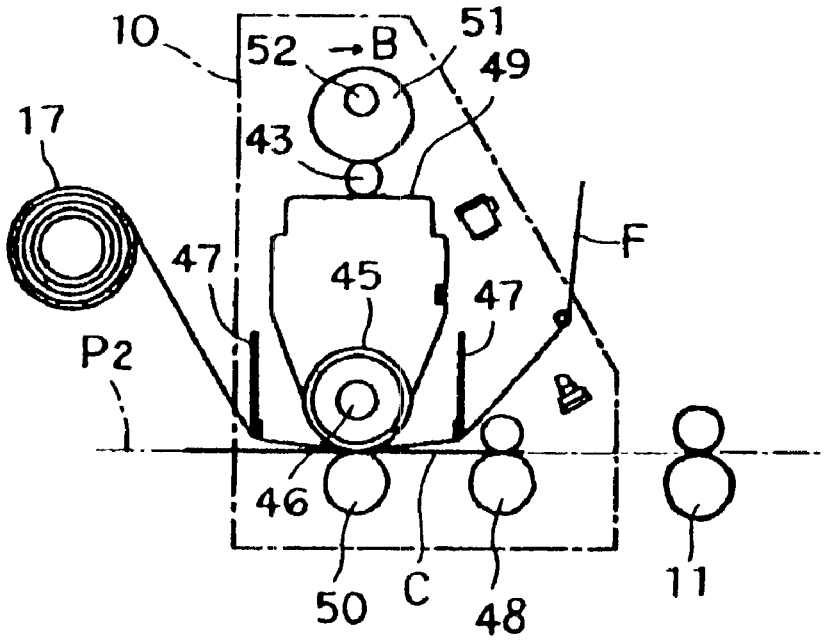
FIG. 7 is a front view of a printing apparatus transfer portion according to the embodiment of the present invention, showing a state that an image is formed on the card via the intermediate transfer sheet.

The transfer portion 10 comprises a platen roller 50 for supporting the card C when transferring from the intermediate transfer sheet F to the card C, and a heat roller 45 arranged to slide with respect to the platen roller 50. Disposed in the heat roller 45 is a heating lamp 46 as a heating body to heat the intermediate transfer sheet F. The intermediate transfer sheet F is interposed between the platen roller 50 and heat roller 45. As shown in FIG. 1 and FIG. 7, the heat roller 45 is moved with respect to the platen roller 50 by such components as a holder 49 supporting the heat roller 45 to be detachable; a follower roller 43 fastened to the holder 49; a non-circular heat roller lifting cam 51 rotating in a direction (a direction of arrow B in FIG. 4) around a cam shaft 52 while contacting an outer surface of the follower roller 43; and a spring (not shown) disposed in the holder 49 for pressing the holder 49 against the heat roller lifting cam 51.

As can be seen in FIG. 1, the intermediate transfer sheet F is supplied from the intermediate transfer sheet supply portion 16 where the intermediate transfer sheet F is wound in a roll. The intermediate transfer sheet F is guided through such components as a transport roller 58 accompanied by a follower roller 59; a guide roller 60; the platen roller 21; a guide roller 91; a back-tension roller 88 for applying a tension to the intermediate transfer sheet F along with a pinch roller 89; a guide roller 92; a guide roller 44; and a guide plate 47 disposed both sides of the heat roller 45 and fixed to a frame constituting the transfer portion 10. When transferring, the intermediate transfer sheet F and the card C are sandwiched between the platen roller 50 and heat roller 45 on the second card transport path P2 (see FIG. 7), and the intermediate transfer sheet F is taken up by the intermediate transfer sheet take-up portion 17. Furthermore, a pair of transport rollers 48 pressing together and driven by a capstan roller is disposed in the transfer portion 10 to transport the card C on the second card transport path P2 in the arrow direction L in FIG. 1 along with a transport roller 61, sandwiching the second card transport path P2 at downstream of the paired horizontal transport rollers 11 and upstream of the platen roller 50. Furthermore, in the image forming portion 10, a light emitting element $S_5$ and a light receiving element $S_6$ are arranged on both sides of the intermediate transfer sheet F between the guide roller 44 and guide plate 47 for detecting a positioning mark of the intermediate transfer sheet F.

Within a region defined by the frame 2, the first card transport path P1 and the second card transport path P2 shown in FIG. 1, a drive mechanism driven by a reversible pulse motor (not shown) is arranged. A rotational drive force transmitted from a pulse motor (not shown) via a torque limiter drives a back-tension roller 88 pressing against a pinch roller 89. A clock plate engages a shaft of the back-tension roller 88. When the intermediate transfer sheet F is transported in the forward and reverse directions, the back-tension roller 88 rotates in synchronization with the intermediate transfer sheet F. A unit transmission sensor (not shown) is arranged near the clock plate to detect a rotation amount of the clock plate to control a feeding amount of the intermediate transfer sheet F. Note that the torque of the intermediate transfer sheet F is controlled to become smaller in the order of the platen roller 21, the transport roller 58 and the intermediate transfer sheet supply portion 16 mounted to the spool shaft.

As can be seen in FIG. 1, on a line to the arrow direction L extended from the second card transport path P2 in the frame 2, a discharge outlet 27 is disposed to discharge the card C to outside of the frame 2 after printing. A detachable stacker 13 is attached to the frame 2 below the discharge outlet 27 for stocking a stack of the cards C. Note a unit transmission sensor S5 (not shown) is arranged at between the cleaner 4 and the horizontal transport portion 5; a unit transmission sensor S6 (not shown) is arranged between the turning portion 5 and the carrier 6*a* (the retracted position); a unit transmission sensor S7 (not shown) is arranged at a side of a pair of the horizontal transport rollers 11 near a pair of the horizontal transport rollers; a unit transmission sensor S8 (not shown) is arranged near a pair of the rollers disposed between a pair of the transport rollers 61 in the horizontal transport path 12 and a pair of the discharge rollers at a side of the rollers 11; and a unit transmission sensor S9 (not shown) is arranged between the horizontal transport discharge portion 12 and the discharge outlet 27. These sensors detect the leading edge or the trailing edge of the card C transported along the first card transport path P1 or the second card transport path P2.

As shown in the FIG. 1, in the frame 2, the printing apparatus 1 is provided with a power supply unit 18 for converting commercial AC power to DC power to drive and operate each mechanism and control unit; the control unit 19 for controlling an entire operation of the printing apparatus 1; and a touch panel 8 disposed on the frame 2 for displaying a status of the printing apparatus 1 according to the information from the control unit 19, and for allowing an operator to input instructions to the control unit 19.

Figure 3:
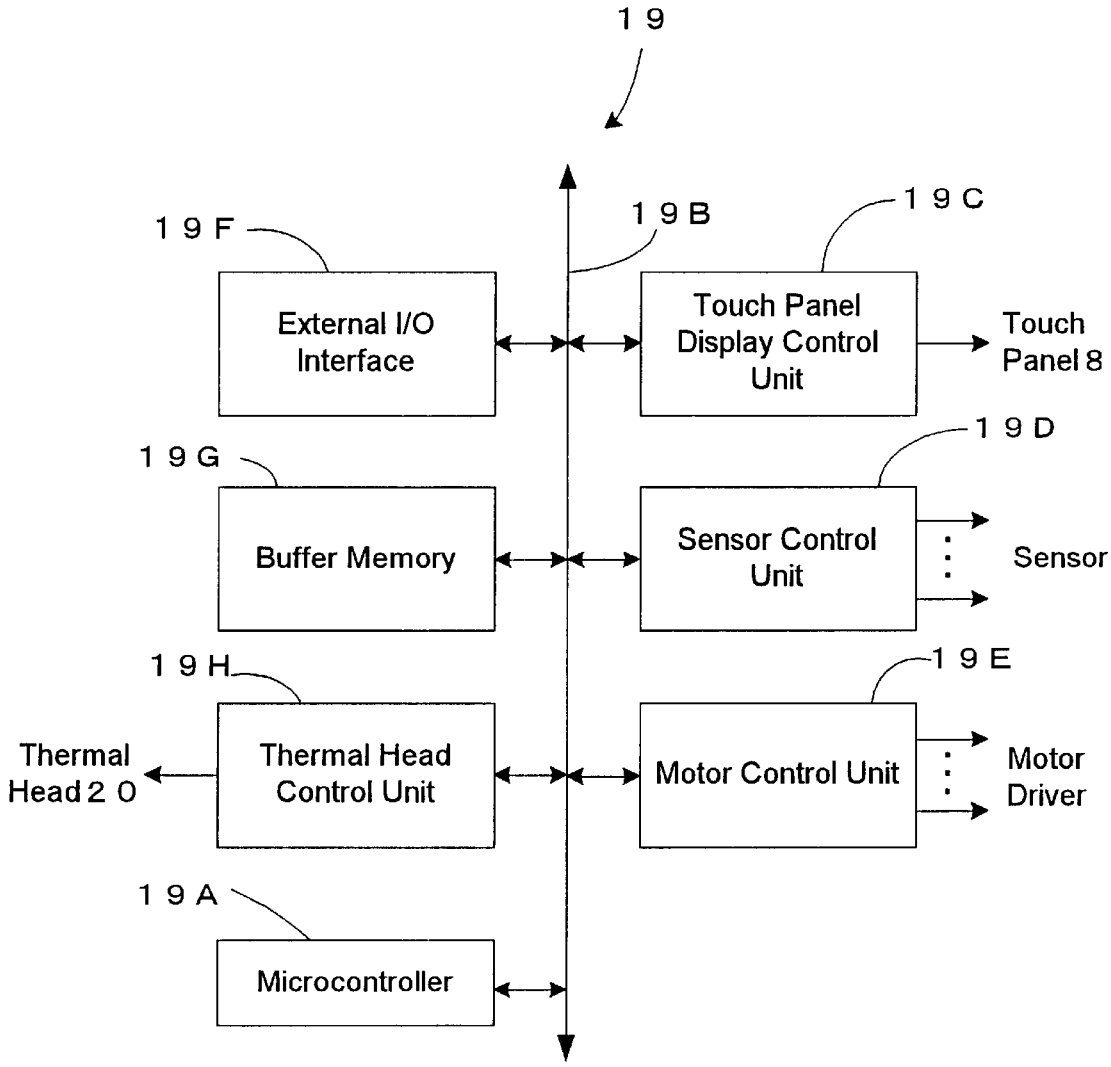
FIG. 3 is a block diagram showing a configuration of a printing apparatus control unit according to the embodiment of the present invention.

As shown in FIG. 3, the control unit 19 includes a micro-controller 19A for processing on the printing apparatus 1. The micro-controller 19A is composed of a CPU for operating under a fast clock speed as a central processing unit, a ROM for storing control instructions for the printing apparatus 1, a RAM working as a work area of the CPU, and an internal bus for connecting these components together.

An external bus 19B is connected to the micro-controller 19A. To the external bus 19B are connected a touch panel display operation control portion 19C for controlling instructions and displays of the touch panel 8; a sensor control portion 19D for controlling a signal from each of the sensors; a motor control unit 19E for controlling a motor driver to output a drive pulse to each of the motors; an external I/O interface 19F for communicating between an external computer and the printing apparatus 1; a buffer memory 19G for temporarily storing image information for printing the card C; and an thermal head control unit 19H for controlling thermal energy of the thermal head 20. The touch panel display operation control unit 19C, the sensor control unit 19D, and the thermal head control unit 19H are connected to the touch panel 8, the sensors including S1 to S9, the drivers including the pulse motor drivers of PM1 to PM4, and the thermal head 20.

With reference to a flow chart, operations of the printing apparatus 1 according to the embodiment of the invention will be explained with focusing on the CPU of the micro-controller 19A in the control unit 19. Assume that the image information received via the external I/O interface 19F and buffer memory 19G from an external computer is stored in the RAM already.

The CPU displays initial information on the touch panel 8 via the touch panel display operation control unit 19C. Then, the CPU stays idle until the operator pushes the touch panel or an external computer sends a signal to input processing information such as using the direct transfer method or the indirect transfer method, printing one side or both sides and which images to be printed. At this point, the touch panel 8 (or the display screen of the external computer) displays a mode button to select the direct, indirect, single side or double side printing method; a mode clear button to clear the selected mode, a start button to start printing with the mode selected on the printing apparatus 1 and to display a screen showing if the printing apparatus 1 is in standby, if it is ready to print or how many cards have been processed. In the following explanation, the operator uses the buttons to set forming images using the direct transfer method on the back surface of the card C, and to form images using the indirect transfer method on the front surface (the surface not formed with a magnetic strip). The explanation describes the actions of the printing apparatus 1 when the start button is pressed, using the example of a duplex transfer routine executed by the CPU.

Figure 4:
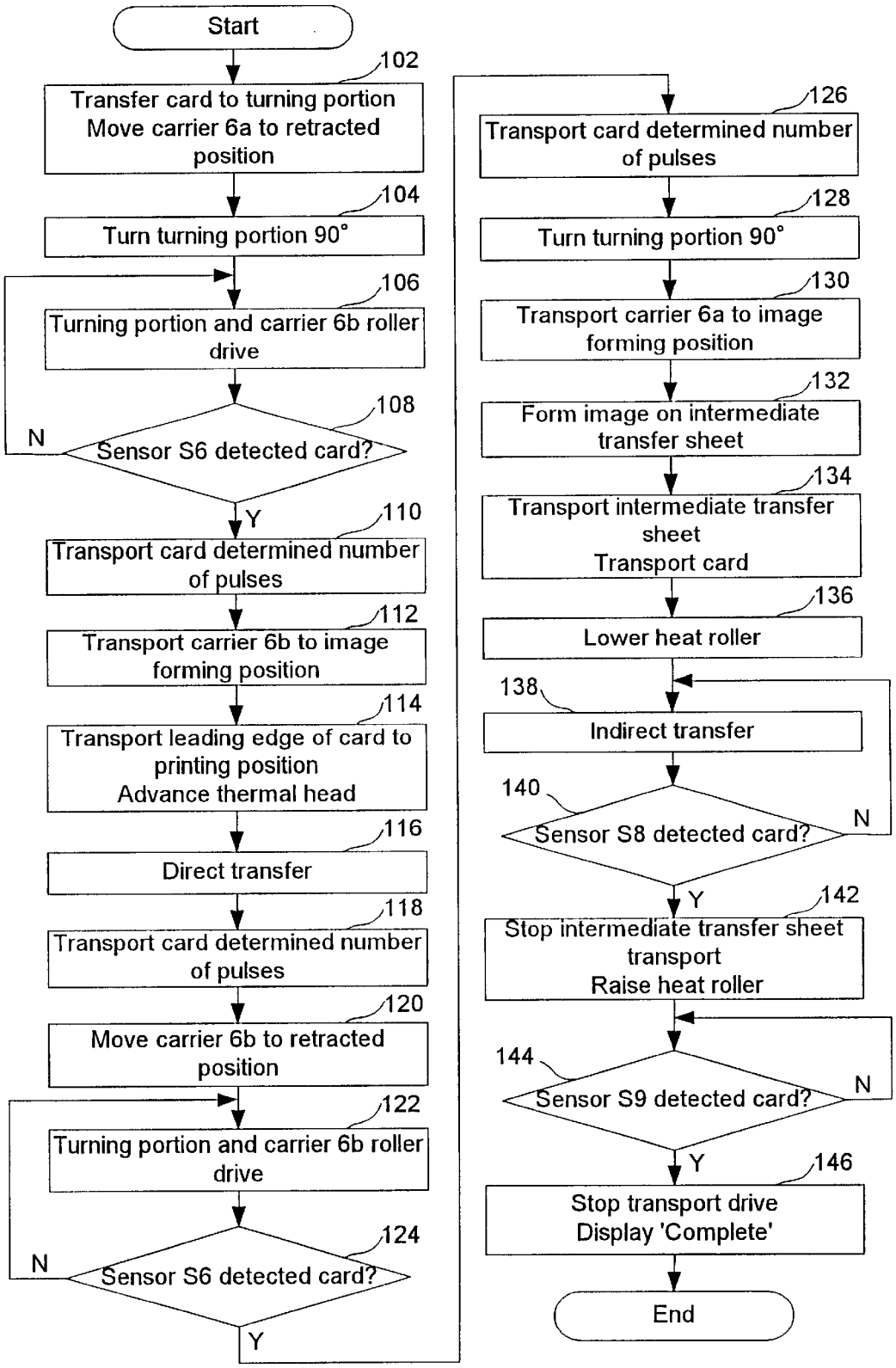
FIG. 4 is a flowchart showing double sides transfer routine executed by the printing apparatus control unit CPU according to the embodiment of the present invention.

As shown in FIG. 4, in the double side printing routine, the CPU first activates the card supply portion 3 arranged on the second card transport path P2, the cleaner 4 and each of the rollers on the turning portion 5 to transport the card C from the card supply portion 3 to the arrow direction L in FIG. 1, so that the pinch rollers 38 and 39 on the turning portion 5 nip the card C. In other words, the kick roller 31 on the card supply portion 3 rotates to transport the card C at the bottom of the card stacker to the second card transport path P2 where the cleaning roller 34 on the cleaner 4 cleans both sides of the card C. When the unit transmission sensor S5 (not shown) arranged between the cleaner 4 and the turning portion 5 detects a leading edge of the card C, the kick roller 31 on the card supply portion 3 is stopped rotating. After transporting from the unit transmission sensor to the turning portion 5 by a determined number of pulses, the card C is stopped (the pinch rollers 38 and 39 are also stopped rotating), and the turning portion 5 in a horizontal position nips the card C.

During that time, the CPU detects output from the unit transmission sensors S1 and S2 and determines whether the carrier 6*a* is positioned at the retracted position (see FIG. 5A) or at the image forming position (see FIG. 1). When the carrier 6*a* is positioned at the retracted position, the pulse motor PM1 (not shown) does not rotate. When the carrier 6*a* is positioned at the image forming position, the pulse motor PM1 (not shown) rotates to move the carrier 6*a* from the image forming position to the retracted position (see FIG. 5A) . While moving the carrier 6*a*, the spool shaft mounted on the intermediate transfer sheet supply portion 16 is rotated in the counterclockwise direction at a determined torque to take up and prevent the intermediate transfer sheet F from sagging from the back-tension roller 88 to the platen roller 21*a*, transport rollers 58 and intermediate transfer sheet supply portion 16. It is possible to verify the output from the unit transmission sensor S2 whether the carrier 6*a* is at the retracted position. When the output from the unit transmission sensor S2 is a high level signal, the spool shaft mounted on the intermediate transfer sheet supply portion 16 is stopped.

At step 104, the turning portion 5 is rotated by 90° into a vertical position so that the card C can be transported in the arrow direction U over the first card transport path P1 (see projected lines in FIG. 1). At step 106, while rotating the pinch rollers 38 and 39, the pulse motor PM4 (not shown) rotates the capstan rollers 74 and 78 of the carrier 6*b* and the platen roller 21*b* to start transporting the card C toward the image forming portion 9 along the first card transport path P1.

At step 108, the unit transmission sensor S6 (not shown) arranged between the turning portion 5 and the carrier 6*b* positioned at the retracted position determines whether a trailing edge of the card C reaches a predetermined position. If it is not the case, the operation returns to the step 106 and the card C continues moving in the arrow direction U. If it is the case, the pinch rollers 38 and 39 on the turning portion 5 are stopped after feeding a predetermined number of the pulses, and the pulse motor PM4 (not shown) stops. Through the steps, both edges of the card C are nipped by a pair of upper and lower rollers on the carrier 6*b* at the retracted position.

Next, at step 112, the CPU drives the pulse motor PM3 (not shown) to move the carrier 6*b* with nipping the card C from the retracted position to the image forming position. At step 114, the pulse motor PM4 (not shown) is driven to transport the card C (see FIG. 5B) so that the leading edge thereof is positioned at the image forming position (the printing starting position) defined above. During that time, the thermal head 20 is positioned away from the platen roller 21*b* and the thermal transfer sheet R is fed by a predetermined length to the printing position Sr, for example at a starting edge of Y (yellow). In order to control the position of the thermal transfer sheet R, the light receiving sensor disposed between the guide rollers 53 detects a trailing edge of the Bk (black) portion on the thermal transfer sheet R, and the unit transmission sensor (not shown) detects the rotation of the clock plate (not shown) disposed near a pair of the take-up rollers 57 to determine a distance between the trailing edge of the Bk (black) portion with a predetermined width and a starting edge of the Y (yellow) portion with a predetermined width on the thermal transfer sheet R. Next, the CPU starts to rotate the thermal head sliding cam 23 on the advancing and retracting unit. At this point, a front side of the card C is supported by the platen roller 21*b* through the rotating action of the thermal head sliding cam 23 in the arrow direction A. A backside of the card C is pressed against the thermal head 20 with the thermal transfer sheet R interposed therebetween.

At step 116, the thermal head 20 thermally transfers the ink layer on the thermal transfer sheet R to the backside of the card C, namely the direct transfer. The CPU converts image data for YMC into heat energy according to the image information in advance, and adds a specific coefficient according to a type of card C and intermediate transfer sheet F to the heat energy to be sent to the thermal head 20 as heating information through the thermal head control unit 19H. Each element of the thermal head 20 is heated according to the heating information.

At step 116, in more detail, the platen roller 21*b* is driven to rotate in the counterclockwise direction. In synchronization, the thermal transfer sheet R is taken-up by the thermal transfer sheet take-up portion 15, and the Y (yellow) image is formed (printed) on the card C by the direct transfer method (See FIG. 6B). After forming the Y (yellow) image portion, the CPU rotates the thermal head sliding cam 23 further in the direction opposite to the arrow A, and retracts the thermal head 20 from the card C. After retracting the thermal head 20, the pulse motor PM4 (not shown) starts driving in reverse, and as shown in FIG. 5B, the leading edge of the card C is positioned at the image forming position, then the pulse motor PM4 (not shown) stops the reverse rotation.

During that time, the CPU feeds the thermal transfer sheet R a little until a leading edge of the next color M (magenta) is positioned at the print starting position Sr. Then, by rotating the thermal head sliding cam 23 further in the arrow direction A, the thermal head 20 is pressed against the card C with the thermal transfer sheet R interposed therebetween. The thermal head 20 forms the image of M (magenta) overlaying the previous color of Y (yellow) on the card C. The CPU repeats the processes in order to overlap images in the YMC inks on the card C. Note that printing on the backside of the card C often uses only one color of Bk (black). In such a case, an image is formed using only Bk (black) according to the same method described above, and image in YMC is not formed. When the image forming on the card C is completed, the CPU rotates the thermal head sliding cam 23 further in the direction opposite to the arrow A, and the thermal head 20 is retracted from the card C.

At step 118, since the card C is not nipped by a pair of the lower rollers immediately after directly printing, the pulse motor PM4 (not shown) is driven to rotate in reverse until both edges of the card C are nipped by a pair of the upper and lower rollers. Next, at step 120, the CPU rotates the pulse motor PM3 (not shown) in reverse to move the carrier 6*b* with nipping the card C from the image forming position to the retracted position. An output from the unit transmission sensor confirms whether the carrier 6*b* is positioned at the retracted position. At step 122, while rotating the pinch rollers 38 and 39 on the turning portion 5 in reverse, the pulse motor PM4 (not shown) is driven in reverse again to rotate a pair of the upper and lower rollers to transport the card C in the arrow direction D.

At step 124, a signal from the unit transmission sensor S6 (not shown) arranged between the turning portion 5 and the carrier 6*b* positioned at the retracted position determines whether the trailing edge of the card C reaches a predetermined position. If it is not the case, the process returns to the step 122 and continues transporting the card C in the arrow direction D. If it is the case, at the next step 126, the CPU transports the card C in the arrow direction by a predetermined number of the pulses. While the CPU stops the reverse rotation of the pulse motor PM4 (not shown) and stops the reverse rotation of the pinch rollers 38 and 39 to nip the card C between the pinch rollers 38 and 39 on the turning portion 5. At the next step 128, the CPU rotates the turning portion 5 by 90° into a horizontal position while nipping the card C so that the card C can be transported in the arrow direction L with the front side upward on the second card transport path P2.

At the next step 130, the pulse motor PM1 (not shown) rotates to move the carrier Ga from the retracted position to the image forming position (see a state in FIG. 1. Note that the pinch rollers 38 and 39 on the turning portion 5 in a horizontal position nip the card C). During that time, the intermediate transfer sheet F is fed from the intermediate transfer sheet supply portion 16 to prevent excessive tension from being applied to the intermediate transfer sheet F. An output from the unit transmission sensor S1 determines whether the carrier 6*a* is at the image forming position. When a high level output from the unit transmission sensor S1 is received, feeding of the intermediate transfer sheet F from the intermediate transfer sheet supply portion 16 is stopped.

At step 132, the thermal head 20 heats the thermal transfer sheet R, and an image is formed on the reception layer Fe on the intermediate transfer sheet F. When forming the image, the pulse motor PM2 (not shown) rotates the platen roller 21*a* in the counterclockwise direction while the intermediate transfer sheet F is take-up on the intermediate transfer sheet supply portion 16. In synchronization, the thermal transfer sheet R is taken up on the thermal transfer sheet take-up portion 15.

At step 132, in more detail, by monitoring an output from the light emitting element (not shown), the CPU recognizes a positioning mark formed on the intermediate transfer sheet F. The unit transmission sensor (not shown) monitors a rotating amount of the clock plate connected to the back-tension roller 88, which rotates forward and reverse always along with feeding or rewinding of the intermediate transfer sheet F, to transport the intermediate transfer sheet F by a predetermined distance to the image forming position. The thermal head 20 is positioned away from the platen roller 21, and, as described above, the thermal transfer sheet R is fed by the predetermined distance to the printing position Sr, for example to the starting edge of Y (yellow). The CPU rotates the thermal head sliding cam 23 further in the arrow direction A when the starting edge of the Y (yellow) portion reaches the printing position Sr and pushes the thermal head 20 to the platen roller 21*a* with the thermal transfer sheet R interposed therebetween. Simultaneously, the pulse motor PM2 (not shown) is driven to rotate the platen roller 21*a* in the counterclockwise direction to take-up the intermediate transfer sheet F at the same speed as the thermal transfer sheet R. Thus, the image is formed using the color Y (yellow) on the intermediate transfer sheet F (See FIG. 6B)

When the forming of the Y (yellow) image on the intermediate transfer sheet F is completed, the CPU rotates the thermal head sliding cam 23 to retract the thermal head 20 from the platen roller 21*a*. By rotating the pulse motor PM1 (not shown) in reverse, the platen roller 21*a* rotates in the clockwise direction and feeds the intermediate transfer sheet F until the positioning mark established thereupon passes the light receiving sensor (not shown). Next, in the same way for the Y (yellow) image, the CPU recognizes the positioning mark established on the intermediate transfer sheet F by monitoring the light receiving sensor (not shown). The CPU monitors the rotating amount of the clock plate 90, which is connected to the back-tension roller 88 that always rotates forward and reverse as one unit to feed or back up the intermediate transfer sheet F, and transports the intermediate transfer sheet F by a predetermined distance to the image print starting position. The thermal transfer sheet R is fed a little until the leading edge of the M (magenta) portion reaches the printing position Sr. In the same manner as the Y (yellow) image, the thermal head sliding cam 23 rotates again to push the thermal head 20 to form an image of the M (magenta) portion onto the Y (yellow) portion on the receptive layer Fe on the thermal transfer sheet R. The CPU repeats the above described process in order to form images in layers using the YMC inks on the intermediate transfer sheet F, then retracts the thermal head 20 from the platen roller 21*a*.

At the next step 134, the intermediate transfer sheet F is transported to the heat roller 45 away from the platen roller 50 in advance, according to an amount of rotation of the clock plate connected to the back-tension roller 88. Note that by monitoring the light receiving sensor disposed between the guide roller 44 and the guide plate 47 in the transfer portion 10 during the transportation, it is possible to detect the positioning mark on the intermediate transfer sheet F and adjust the transportation amount to improve the accuracy of the transportation. At step 134, while transporting the intermediate transfer sheet F to the transfer portion 10, the CPU drives the pinch rollers 38 and 39 on the turning portion 5, a pair of the horizontal transport rollers 11, a pair of the transport rollers 48 and a plurality of rollers on the horizontal transport portion 12 to transport the card C in the arrow direction L over the second card transport path P2. When the unit transmission sensor S7 arranged on a pair of the horizontal transport rollers 11 side near the transport roller 48 detects the leading edge of the card C, the card is transported further by a predetermined number of the pulses in the arrow direction L. The leading edge of the card C is transported and abuts against the heat roller 45.

At the next step 136, the CPU rotates the heat roller elevator cam 51 in the arrow direction B to shift the heat roller 45 to touch the platen roller 50 (see FIG. 7), and then stops the heat roller elevator cam 51. At this point, at the leading edge of the card C, the platen roller 50 supports the backside and the front side touches the heat roller 45 with the intermediate transfer sheet F interposed therebetween.

Next, at step 138, the image formed on the reception layer Fe on the intermediate transfer sheet F is indirectly transferred to the front surface of the card C at the image forming portion 9 using the heat roller 45. More specifically, the card C is transported in the arrow direction L while the backside thereof is supported by the platen roller 50 rotating in the counterclockwise direction and the front side contacts the heat roller 45 with the intermediate transfer sheet F interposed therebetween. The peeling layer Fc on the intermediate transfer sheet F is peeled off the base film Fa by the heat of the heating lamp 46, and the layer Fe with the image formed thereon and the overcoat layer are transferred together to the surface of the card C. In synchronization to this transfer, the intermediate transfer sheet F is taken up by the intermediate transfer sheet take-up portion 17. During this time, at step 140, by monitoring the output from the unit transmission sensor S8 arranged at side of a pair of the discharge rollers near a pair of the rollers arranged between a pair of the transport rollers 61 and a pair of the discharge rollers on the horizontal transport path 12, it determines whether the intermediate transfer is completed. If is not the case, the process returns to the step 138 and continues the indirect transfer. If is the case, the process proceeds to the next step 142. Note that the card C and the intermediate transfer sheet F are transported at the same speed during the intermediate transfer.

At step 142, the CPU stops transporting the intermediate transfer sheet F (taking up to the intermediate transfer sheet take-up portion 17) and re-rotates the heat roller elevator cam 51 to retract the heat roller 45 from the platen roller 50. At step 144, the CPU idles until the trailing edge of the card C is detected by the unit transmission sensor S9 arranged between the horizontal transport portion 12 and the discharge outlet 27. When the trailing edge of the card C is detected, the CPU stops driving the rollers on the second card transport path P2 after a predetermined amount of time at step 144. The CPU displays the number of the processed cards or completion of the processing on the touch panel 8. The card C passes the horizontal transport portion 12 and is discharged to the stacker 13 through the discharge outlet 27.

Next, effects of the printing apparatus 1 according to this embodiment will be described.

The printing apparatus 1 according to the present embodiment comprises the image forming portion 9 for forming an image on the card C or the intermediate transfer sheet F, and the transfer portion 10 for transferring an image formed on the intermediate transfer sheet F to the card C. Thus, it is possible to print with both the direct transfer and indirect transfer printing methods. Furthermore, the touch panel 8 (or an external computer) can select the direct print method or the indirect print method on the front or the backside of the card C. Also, the printing apparatus 1 of the embodiment employs a configuration to move the carriage 6*a* having the platen roller 21*a* with the intermediate transfer sheet F wound thereupon to the image forming position and the retracted position when forming the image on the card C and the intermediate transfer sheet F at the image forming portion 9. Thus, when one of the transfer methods is selected using the touch panel 8 (or so instructed from an external computer), it is possible to prohibit the use of the other transfer method. For that reason, it is possible to reduce errors or problems in the mechanism relating to entangling or winding of the intermediate transfer sheet F inside the frame 2 because of a complex structure. By reducing errors and problems, it is possible to improve the printing performance of printing apparatus 1 such as the processing speed per a number of the cards. Moreover, in a complex mechanism such as this printing apparatus 1, it is not sufficient to prevent all problems completely just by using software to prohibit the image forming on the intermediate transfer sheet F (by using a program that includes a step of prohibiting the image forming on the intermediate transfer sheet F) controlled by only the micro-controller in the control unit 19 (frequently it is impossible to prevent mechanical problems). particularly, considering a so-called runaway state of a micro-controller happened once every 100,000 times, it is preferable to provide a mechanism for retracting (separating) the intermediate transfer sheet F described above, or a retracting (separating) method in terms of the safety and protection of the printing apparatus 1.

Figure 8:
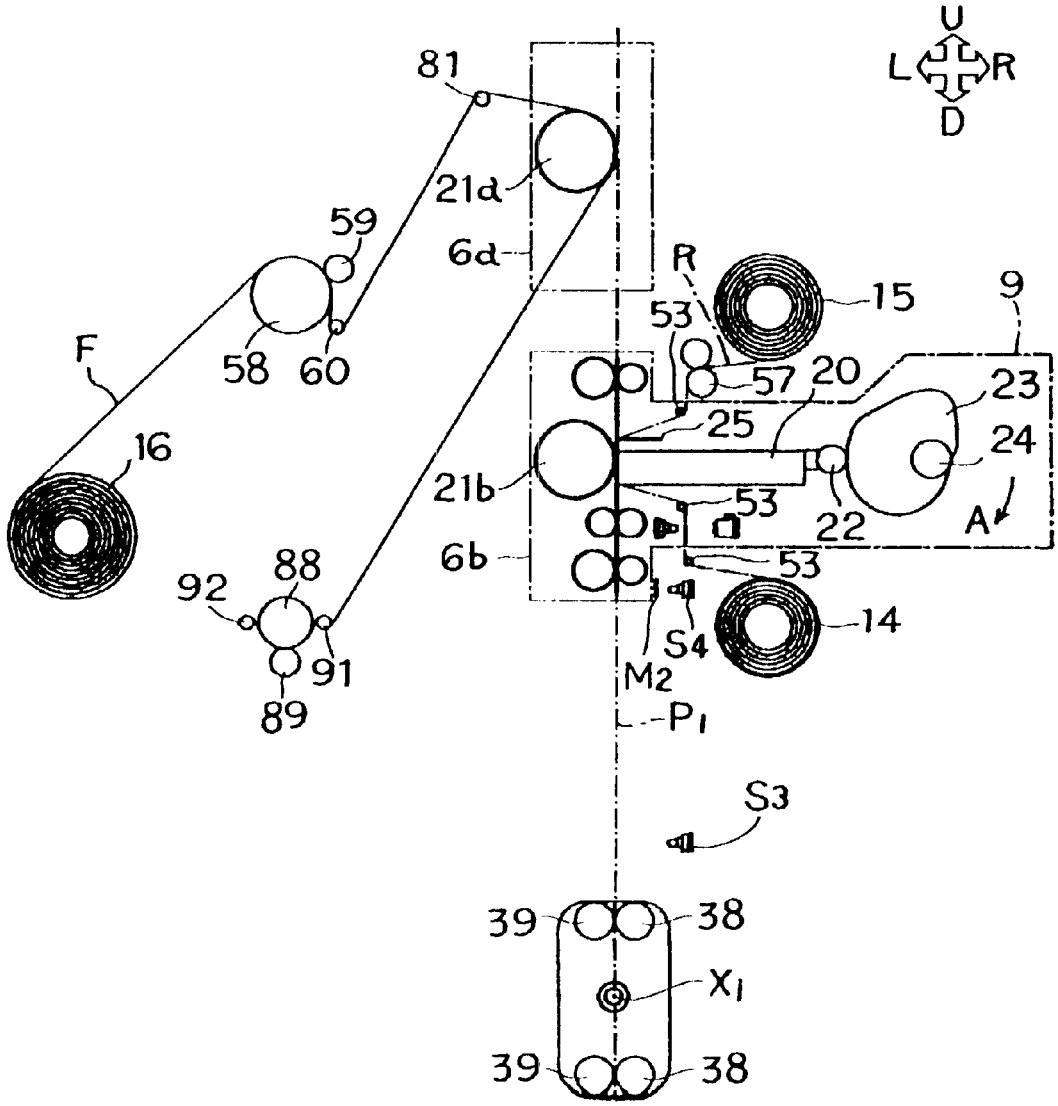
FIG. 8 is a front view near the first card transport path of a printing apparatus according to another embodiment of the present invention.

Note that according to the embodiment, the carrier 6*a* is moved in the X direction and the carrier 6*b* in the Y direction to prohibit the image forming on the intermediate transfer sheet F. However, both the carrier 6*a* and the carrier 6*b* may move in the Y direction (in the arrow direction U or the arrow direction D), as can be seen in FIG. 8. In this case, the guide roller 81 is arranged to wind the intermediate transfer sheet F from above the platen roller 21*a* along with the carrier 6*a* moving in the Y direction (in the arrow direction U). Thus, it is possible to prevent sagging of the intermediate transfer sheet F transported in the reverse direction from the platen roller 21*a* and winding up on the platen roller 21*a*.

Figure 9:
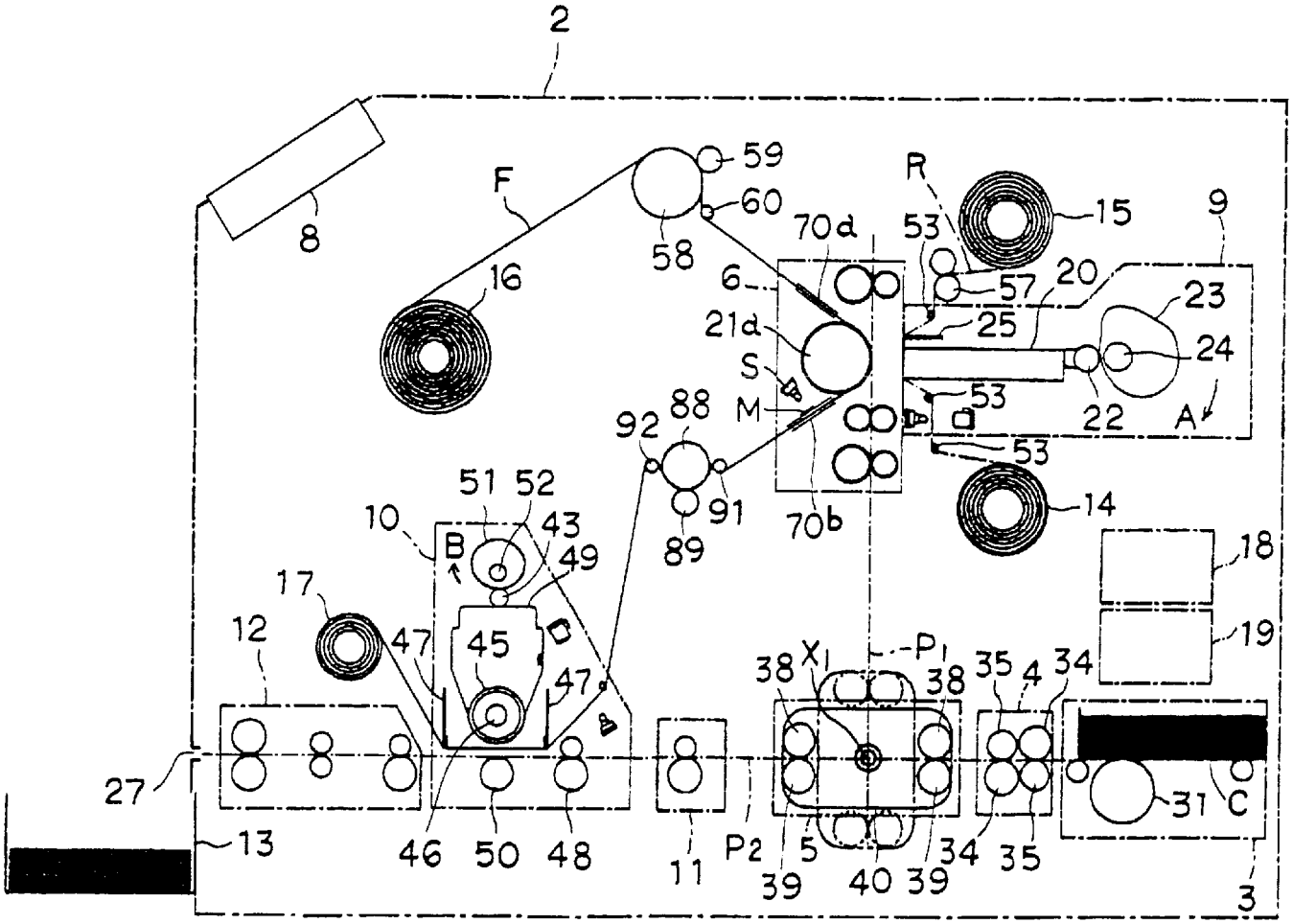
FIG. 9 is a front view of a printing apparatus according to another embodiment the present invention.

Also, as another way of retracting the intermediate transfer sheet F, in FIG. 9, a printing apparatus is equipped with a substantially U-shaped intermediate transfer sheet holding members 70*a* and 70*b* with an opening facing either an upper or a lower direction for holding the intermediate transfer sheet F at a position opposite to the thermal head 20 and near the platen roller 21*a*. A mirror M is mounted on either of the intermediate transfer sheet holding members 70*a* or 70*b*, and a unit transmission sensor S is arranged in a position corresponding to the mirror M. When not performing the intermediate transfer, the intermediate transfer sheet holding members 70*a* and 70*b* retract in either upward or downward in FIG. 9 (the Z direction) (to separate from the platen roller 21*a* ). When performing the intermediate transfer, the intermediate transfer sheet holding members 70*a* and 70*b* rise or lower in synchronization to position the intermediate transfer sheet F at the image forming position in contact with the platen roller 21*a*. With this contact, the unit transmission sensor S detects that the image forming with the intermediate transfer sheet F is possible. The intermediate transfer sheet supply portion 16 feeds the intermediate transfer sheet F according to the movement of the intermediate transfer sheet holding members 70*a* and 70*b* in the Z direction (to feed or take-up the intermediate transfer sheet F). It is preferable to set a length of the intermediate transfer sheet holding members 70*a* and 70*b* to be longer than a length of the intermediate transfer sheet F contacting the platen roller 21 to prevent excess tension of the intermediate transfer sheet F. Note that with the printing apparatus according to this embodiment, the platen roller 21*a* and capstan roller are positioned at a fixed image forming position.

Also, in this embodiment, a pair of the upper and lower rollers, and a pair of the rollers with no drive disposed between the platen roller 21*b* and a pair of the lower rollers move along with the carrier 6*b*. However, as shown in FIG. 9, they may be mounted in fixed positions and only the platen roller 21*a* may move in the X direction. Thus, it is possible to prohibit the intermediate transfer by retracting the intermediate transfer sheet F from the image forming position to the retracted position. Also, in this embodiment, the carriers 6*a* and 6*b* move between the image forming position and the retracted position through a rack and pinion mechanism, however it is also possible to attain highly precise movement using a linear pulse motor as well.

Also, in the embodiment, there is only one image forming portion 9, however this invention is not limited to one and can also comprise a plurality of the image forming portions 9 (for example two). In such a case, one image forming portion forms an image on the card C, and the other image forming portion forms an image on the intermediate transfer sheet F, thereby further enhancing the printing speed while reducing errors such as entangling of the intermediate transfer sheet.

As described above, according to the invention, the image is formed on the recording medium by the printing means according to the selected mode. Because the image formed on the intermediate transfer medium by the printing means is transferred to the recording medium by the transfer means, it is possible to switch between the direct transfer method and the indirect transfer method when printing the recording medium. Also, it is possible for the intermediate transfer medium moving means to retract the intermediate transfer medium to the retracted position according to the selected mode to prohibit the other transfer means when one transfer means is selected, thereby decreasing problems associated with printing and improving the printing performance.

While the invention has been explained with reference to the specific embodiments, the explanation is illustrative and the invention is limited only by the appended claims.

What is claimed is:

1. A printing apparatus for printing a recording medium and an intermediate transfer sheet for temporarily holding an image, comprising:

a supply portion for storing the recording medium, a transport path extending from the supply portion, recording medium transport means disposed at the transport path for transporting the recording medium supplied from the supply portion along the transport path, at least one printing means arranged on the transport path for forming an image on one of the recording medium and the intermediate transfer sheet at a predetermined image forming position, transfer means arranged on the transport path for transferring an image formed on the intermediate transfer sheet to the recording medium, mode setting means for selecting one of a first mode in which said printing means forms the image on the recording medium and a second mode in which the printing means forms the image on the intermediate transfer sheet; and intermediate transfer sheet moving means electrically connected to the mode setting means for moving the intermediate transfer sheet between the image forming position and a retracted position located away from the transport path according to a selection of the first mode or second mode by the mode setting means, said intermediate transfer sheet moving means moving the intermediate transfer sheet away from the transport path when required.

2. A printing apparatus according to claim 1, wherein said intermediate transfer sheet moving means moves the intermediate transfer sheet to the retracted position when the mode setting means selects the first mode.

3. A printing apparatus according to claim 1, wherein said intermediate transfer sheet moving means moves the intermediate transfer sheet to the image forming position when the mode setting means selects the second mode.

4. A printing apparatus according to claim 2, wherein said intermediate transfer sheet moving means moves the intermediate transfer sheet to the image forming position when the mode setting means selects the second mode.

5. A printing apparatus according to claim 1, wherein said intermediate transfer sheet moving means comprises a first platen for contacting the intermediate transfer sheet on an outer circumference thereof, and a second platen arranged adjacent to the first platen, one of said first and second platens being arranged to face the printing means.

6. A printing apparatus according to claim 1, further comprising a platen with a periphery disposed to face the printing means, said intermediate transfer sheet moving means allowing the intermediate transfer sheet to be able to contact with and separate from the periphery of the platen.

7. A printing apparatus according to claim 1, further comprising a first carrier having a first platen for carrying the recording medium in the first mode, and a second carrier having a second platen for carrying the intermediate transfer sheet and forming the intermediate transfer sheet moving means.

8. A printing apparatus according to claim 7, wherein said first carrier is located to face the at least one printing means in the first mode while the second carrier is located in the retracted position, and the second carrier is located to face the at least one printing means in the second mode.

9. A printing apparatus according to claim 8, wherein said transfer means is located away from the first and second platens and has means for receiving the intermediate transfer sheet passing through the intermediate transfer sheet moving means.

* * * * *